US008182372B2

(12) United States Patent
Hayes

(10) Patent No.: US 8,182,372 B2
(45) Date of Patent: May 22, 2012

(54) DEVICE FOR TRAINING ATHLETIC OR SPORTS BALL PLAYERS

(76) Inventor: Bernard Hayes, Ridgewood, NJ (US)

( * ) Notice: Subject to any disclaimer, the term of this patent is extended or adjusted under 35 U.S.C. 154(b) by 0 days.

(21) Appl. No.: 12/456,052

(22) Filed: Jun. 11, 2009

(65) Prior Publication Data

US 2010/0062880 A1 Mar. 11, 2010

Related U.S. Application Data

(60) Provisional application No. 61/131,994, filed on Jun. 13, 2008.

(51) Int. Cl.
*A63B 69/00* (2006.01)

(52) U.S. Cl. ..... 473/438; 473/454; 473/446; 273/400; 273/401

(58) Field of Classification Search ..... 273/398–402; 473/456, 476, 478, 197, 438, 454, 446
See application file for complete search history.

(56) References Cited

U.S. PATENT DOCUMENTS

| | | | | |
|---|---|---|---|---|
| 1,527,988 | A | 3/1925 | McMurtrie | |
| 1,923,152 | A * | 8/1933 | Kohn | 473/190 |
| 2,247,852 | A * | 7/1941 | Saunders | 273/412 |
| 2,978,246 | A | 4/1961 | Van Groningen | |
| 3,312,467 | A | 4/1967 | Dawson | |
| 3,575,415 | A * | 4/1971 | Fulp et al. | 273/400 |
| 3,580,578 | A | 5/1971 | McCarthy | |
| 3,583,703 | A | 6/1971 | Brown | |
| 3,822,883 | A * | 7/1974 | De Vos | 273/400 |
| 3,918,711 | A * | 11/1975 | Zak | 473/462 |
| 4,173,337 | A | 11/1979 | Okonowski | |
| 4,492,380 | A | 1/1985 | Saytar | |
| 4,497,485 | A | 2/1985 | Macosko | |
| 4,796,886 | A * | 1/1989 | Loh | 473/462 |
| 4,921,257 | A | 5/1990 | Heller | |
| 4,930,774 | A | 6/1990 | Butcher | |
| 5,000,461 | A | 3/1991 | Borazjani | |
| 5,096,191 | A | 3/1992 | Fang | |
| 5,217,230 | A | 6/1993 | Judd | |
| 5,516,115 | A | 5/1996 | McLain | |
| 5,725,444 | A | 3/1998 | Heden | |
| 5,941,529 | A * | 8/1999 | Kinsey | 273/401 |
| 6,620,065 | B2 * | 9/2003 | Clabough | 473/454 |
| 6,736,738 | B1 | 5/2004 | Taa | |
| 6,811,501 | B2 | 11/2004 | Kuzia et al. | |
| 6,860,825 | B2 | 3/2005 | Clark | |
| 6,878,078 | B2 | 4/2005 | Swanson | |
| 6,889,982 | B1 * | 5/2005 | Gove | 273/343 |
| 7,052,408 | B1 * | 5/2006 | Leonard | 473/197 |
| 7,401,785 | B1 * | 7/2008 | Waite | 273/400 |
| 2003/0125121 | A1 * | 7/2003 | Rhee | 473/195 |
| 2004/0038759 | A1 * | 2/2004 | Kuzia et al. | 473/478 |
| 2005/0192126 | A1 * | 9/2005 | Remaklus | 473/447 |
| 2005/0200079 | A1 * | 9/2005 | Barber | 273/400 |

* cited by examiner

*Primary Examiner* — Mark Graham
(74) *Attorney, Agent, or Firm* — Klauber & Jackson LLC

(57) ABSTRACT

The present invention provides a device designed to increase the accuracy of both the throwing, bouncing, propelling by stick and kicking of a baseball, football, lacrosse ball or soccer ball. The apparatus is constructed of a frame, for example of aluminum tubing. A net is attached to or hung over the aluminum tubing to provide a series of pouches aligned horizontally at various heights. These pouches provide target areas for a ball. The pouches may be designed to allow the ball to drop from a pouch it enters into a second pouch or to the bottom of the device for easy removal. The device is held by a base that may have wheels and may be steadied by one or more transverse supports running across the bottom or the back of the base.

14 Claims, 6 Drawing Sheets

DEVICE FOR TRAINING ATHLETIC OR SPORTS BALL PLAYERS

CROSS-REFERENCE TO RELATED APPLICATIONS

The present application claims the benefit under 35 U.S.C. §119(e) of U.S. provisional application 61/131,994, filed Jun. 13, 2008, the disclosure of which is herein incorporated by reference.

BACKGROUND OF THE INVENTION

In baseball, it is an object for the pitcher to throw the ball into an area defined as the strike zone, or at least in reasonable proximity thereto. Training aids for pitching practice have been devised to assist would be pitchers to enhance their throwing skill. One such apparatus is shown and described in U.S. Pat. No. 2,978,246 describes a target device including a rectangular generally transparent target plate of a size approximating the strike zone. The target plate is mounted on a pole member having a resilient portion to permit twisting or deflection on impact. U.S. Pat. No. 3,583,703 describes a framework formed of releasable and connectable tubular members, with string members suspended therein to define a strike zone, divided into four generally equally dimensioned parts. U.S. Pat. No. 3,312,467 describes another open framework with strike zone. Another pitching training device is disclosed in U.S. Pat. No. 4,173,337 including a framework supporting a plurality of hingedly connected and/or suspended rectangular, preferably rubber, pads arranged in a way to define an opening corresponding to the strike zone. U.S. Pat. No. 4,930,774 describes a baseball pitching training apparatus. U.S. Pat. No. 6,878,078 even discloses a padded leather pitching target that is designed to simulate the sound of a baseball hitting a glove.

As with baseball, a soccer player must develop skills in shooting and scoring. Shots must be both accurate and powerful. Typically, players must travel to a soccer field in order to practice shooting skills. Besides the inconvenience, it is also difficult to simulate and practice strategic shots without additional players. Players may also mark targets on large rigid walls to develop shooting skills. If multiple players are shooting at the same target, the task of observing which ball hit a particular target becomes even more difficult. Moreover, the rigid wall increases the risk of injury to a player. Further, the simulation of real game situations is limited. U.S. Pat. No. 1,527,988 describes a net device comprising entirely of cells and used to play a game with a golf ball. U.S. Pat. No. 3,580,578 describes a goal for a bouncing ball game. U.S. Pat. No. 4,492,380 describes a goal assembly for a modified basketball and hockey game. U.S. Pat. No. 3,822,883 describes a target with compartments for playing a ball game where a ball is thrown into the compartments for points. U.S. Pat. No. 4,497,485 describes a baseball pitching target. U.S. Pat. No. 5,037,095 describes a quarterback trainer apparatus. U.S. Pat. No. 5,096,191 describes a basketball training apparatus with hoops. None of the references, however, contains the suggestion that the device may be modified for soccer and used for developing a player's foot and shooting skills. U.S. Pat. No. 4,921,257 describes a training device that is limited for use in connection with a conventional soccer goal. U.S. Pat. No. 5,000,461 describes a complex device which can reposition a single target cup; however, this device is prohibitively expensive to manufacture. U.S. Pat. No. 5,217,230 describes a multi-sports net with a single pouch being attached to the net by a rigid tubular ring of circular configuration. U.S. Pat. No. 5,725,444 also describes a device for training soccer players. U.S. Pat. No. 6,860,825 describes a game combining strategy and ball kicking skills similar to soccer. U.S. Pat. No. 6,811,501 B2 discloses a free standing partitioned goal especially for use in improving kicking skills.

As with baseball and soccer, football players strive to improve their ability to accurately deliver a ball to a specific location accurately. U.S. Pat. No. 6,736,738 describes a football target apparatus. U.S. Pat. No. 5,516,115 describes a portable ball practice target applicable to several ball games and sports.

U.S. Pat. No. 6,736,738 describes a football target apparatus, but it is not mounted on wheels, has no rectangular or square base, does not provide a catching assembly constructed of netting and aluminum tubing of about 1.5" to 2.0" outside diameter. Likewise, it provides no assembly that allows a ball to drop to the bottom of the device for easy access and removal.

U.S. Pat. No. 4,930,774 describes a baseball pitching training apparatus. However, this apparatus is not mounted on wheels having either a rectangular or square base, the frame is rectangular, and is 7-9 feet high. Likewise, it provides no assembly that allows a ball to drop to the bottom of the device for easy access and removal.

U.S. Pat. No. 5,725,444 describes a device for training soccer players. However, this apparatus also is not mounted on wheels having either a rectangular or square base, the frame is rectangular, and is 7-9 feet high. Likewise, it provides no assembly that allows a ball to drop to the bottom of the device for easy access and removal.

U.S. Pat. No. 6,860,825 describes a game combining strategy & ball kicking skills. However, it does not describe an apparatus having a base on wheels having either a rectangular or square base. It does not describe target areas (pouches) that allow for a ball to drop to the bottom of the device for easy access and removal. Moreover, its target areas are aligned vertically, not horizontally, and there is no partial obstruction to the target area—it is wide open to allow for clean penetration for the ball.

U.S. Pat. No. 6,811,501 describes a free standing partitioned goal. However, it also does not describe an apparatus having a base on wheels having either a rectangular or square base. It does not describe target areas (pouches) that allow for a ball to drop to the bottom of the device for easy access and removal. Moreover, its target areas are aligned vertically, not horizontally.

U.S. Pat. No. 6,878,078 describes a padded leather pitching target. However, it also does not describe an apparatus having a base on wheels having either a rectangular or square base. Its target areas allow for a ball to bounce off, and it is designed for throwing a baseball specifically.

U.S. Pat. No. 5,725,444 describes a device for training soccer players. However, it also does not describe an apparatus having a base on wheels having either a rectangular or square base and a rectangular frame from 7-9 feet high. In addition, it does not describe target areas (pouches) allowing for a ball to drop to the bottom of the device for easy access and removal. In addition, its target areas are aligned vertically.

U.S. Pat. No. 5,516,115 describes a portable ball practice target. However, it also does not describe an apparatus having a base on wheels having either a rectangular or square base and a rectangular frame from 7-9 feet high. In addition, it does not describe target areas (pouches) allowing for a ball to drop to the bottom of the device for easy access and removal. In addition, its target areas are aligned vertically, and there is only one.

Accordingly, it is an object of the present invention to provide a new and improved baseball pitching, football throwing or soccer kicking training apparatus, that enables the pitcher, thrower or kicker to concentrate on pitching, throwing or kicking inside, outside, and to the corner of a strike zone, while at the same time keeping the ball either low or high. Other objects, features and advantages will become apparent from a reading of the following specification taken in conjunction with the drawings.

SUMMARY OF THE INVENTION

The present invention provides a device designed to increase the accuracy of one or more of the throwing, batting, bouncing, propelling by stick and kicking of an athletic or sports ball such as a baseball, softball, basketball, football, lacrosse ball or soccer ball. The apparatus is constructed of a scaffolding, frame, or base, for example of aluminum tubing or plastic tubing. A mesh or fabric is attached to, hung over or substantially encases the scaffolding, frame, or base. Further, the mesh or fabric provides a plurality of pouches that may be aligned horizontally at various heights from top to bottom of the device. These pouches provide a target area for the athletic or sports ball. The pouches are optionally designed to allow the ball to drop from a pouch it enters to a second pouch or to the bottom of the device for easy removal. The device may be held by a base having wheels and may be steadied by one or more cross bars running across the bottom of the base.

In some embodiments, the present invention provides an athletic ball training device having a) a frame, scaffold or base having a top, a bottom, and two sides, b) a mesh or fabric adapted to attach to, encase or drape over said frame, scaffold or base, and c) one or more pouches attached to or formed by said mesh or fabric, wherein said one or more pouches are adapted to receive a sports ball therein. One or more pouches may be defined by a substantially arc shaped border on at least one side and wherein said substantially arc shaped border defines an aperture of sufficient size to allow passage of an athletic ball. In preferred embodiments, there is a plurality of pouches, preferably at least 3, 4, 5, 6, 7, 8, 9, or 10 pouches. The device may further have a means of rolling, such as one, two, three, or four or more wheels connected to the bottom thereof. In some embodiments, one or more of the wheels may be lockable. The scaffold, frame or base has a top defined by the frame, the top having a width and a length, a base, defined by the frame, the base substantially parallel to the top, the base having a width substantially the same as a width of the top. The device may be constructed of any suitable size, for instance at least about 3 feet, 4 feet, 5 feet, 6 feet, 7 feet, 8 feet, 9 feet or 10 feet, 15 feet or 20 or more feet tall. Especially useful devices are about 7 feet to about 9 feet tall. In some embodiments, the device is at least about 1 foot wide, 2 feet wide, 3 feet wide, 4 feet wide, 5 feet wide, 6 feet wide, 10 feet wide or even 15 feet or 20 feet wide if desired. Especially preferred are devices in the 2 feet to 3 feet wide range. Preferred devices provide a substantially symmetric frame configuration.

In some embodiments, the mesh or fabric is adapted to substantially encase at least two or three vertical members of the scaffolding, frame or base and the mesh or fabric is adapted to substantially encase at least three horizontal members of the scaffolding, frame or base at the top of the device, and the mesh or fabric is adapted to substantially encase at least two or three horizontal members of the scaffolding, frame or base at the bottom of the device. By encasing the members of the scaffolding, frame or base, the mesh or fabric engages the frame much as a sock does a foot, a glove a hand or a pillowcase a pillow. In further embodiments, the scaffolding, frame or base is formed of a plastic or an aluminum, such as plastic or aluminum piping. The plastic or aluminum piping may have a diameter of about, for instance, ½", 1 inch, 1¼", 1½", 1¾", 2", 2½" or more. The mesh or fabric may be formed of knitted nylon, cotton, hemp, polypropylene, and rayon. Many commercially available meshes suitable for, for instance, soccer goals and driving ranges may be used.

The device may be useful for training athletes in the games of baseball, soccer, basketball, lacrosse or football. The device may be applicable to practicing throwing, bouncing, batting, propelling by stick or kicking skills. In some embodiments, the pouches are provided with an aperture allowing passage of a ball from one pouch to another. In still further embodiments, the mesh or fabric is provided to form a collection surface or collection pouch at the bottom of the device, underneath the other pouches. The bottom surface therefore provides no aperture to allow a ball to pass to the floor or ground underneath. This feature allows easy collection of a ball after it is thrown, bounced, or kicked into a pouch.

DETAILED DESCRIPTION OF THE INVENTION

Figure 1:
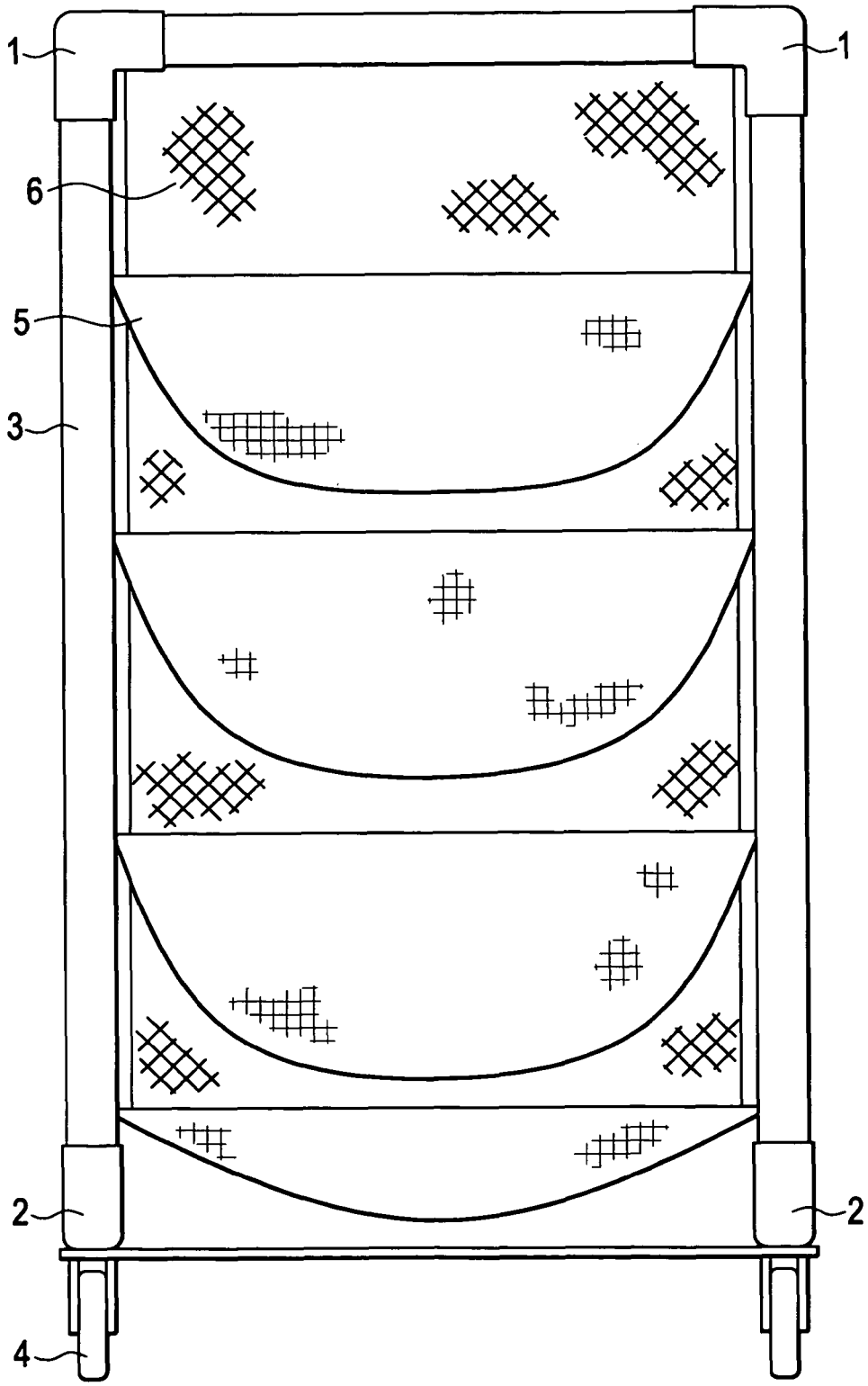
FIG. 1 is a frontal view of the device.

Some of the preferred embodiments are described with reference to the figures. With reference to FIG. 1, a three way connector 1 mates three members 3 of a frame at three or four positions on the top of the device forming a substantially square or rectangular shape. A two way connector 2 mates two members 3 of a frame at three or four positions on the bottom of the device forming a substantially square or rectangular shape. Thereby a scaffolding, frame or base is formed. Wheels 4 are mounted onto the scaffolding, frame or base to provide a means for easy movement. Pouches 5 are found present in a netting 6 to serve as a target for collecting a ball. The netting may be permanently affixed to the scaffolding, frame or base or temporarily affixed thereto, such as, for instance draped over or encasing the scaffolding, frame or base.

Figure 2:
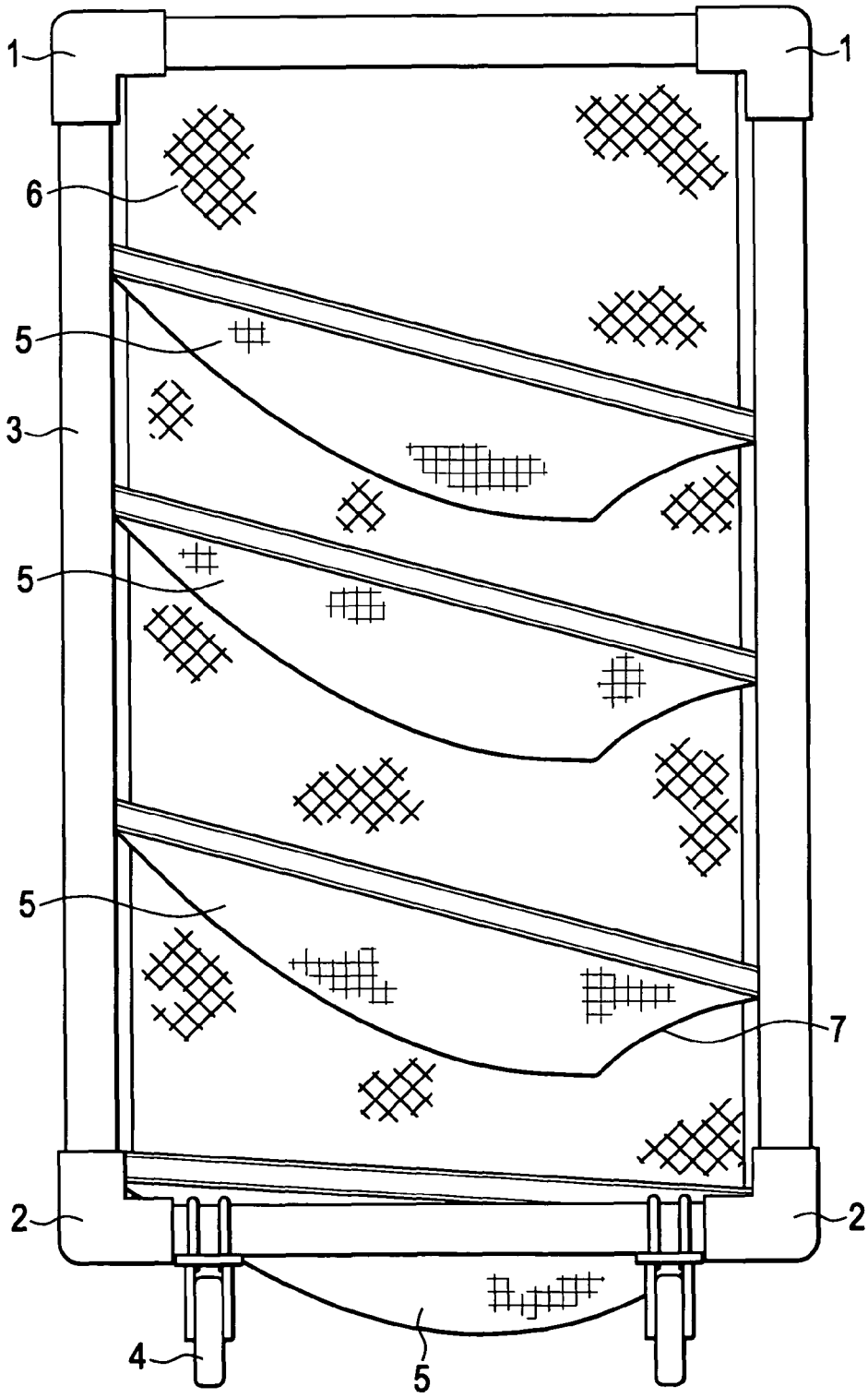
FIG. 2 is a left or right side view of the device illustrating slanted pouches designed to retain a ball and prevent bouncing out of the pouches.

With reference to FIG. 2, a three way connector 1 mates three members 3 of a frame at three or four positions on the top of the device forming a substantially square or rectangular shape. A two way connector 2 mates two members 3 of a frame at three or four positions on the bottom of the device forming a substantially square or rectangular shape. Thereby a scaffolding, frame or base is formed. Wheels 4 are mounted onto the scaffolding, frame or base to provide a means for easy movement. Pouches 5 are found present in a mesh or fabric 6 to serve as a target for collecting a ball. The mesh or fabric may be permanently affixed to the scaffolding, frame or base or temporarily affixed thereto, such as, for instance draped over or encasing the scaffolding, frame or base. The rear extent or surface of the pouches 7 may define a substantially arc shaped aperture to allow passage of a ball from one pouch to another or to a bottom surface for easy collection.

Figure 3A:
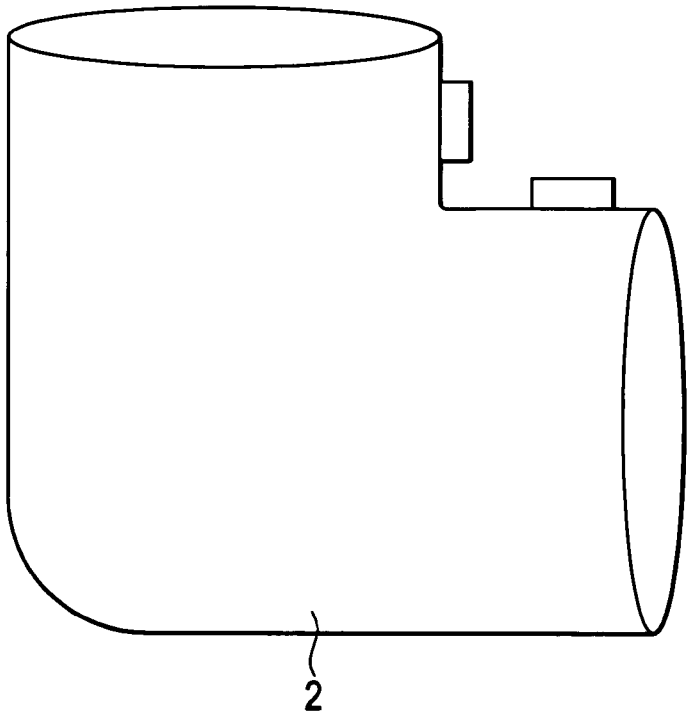
FIG. 3 A represents a two way connector and FIG. 3B represents a three-way connector adapted to connect the members of the scaffolding that together serve as a frame or base for the pouches.
Figure 3B:
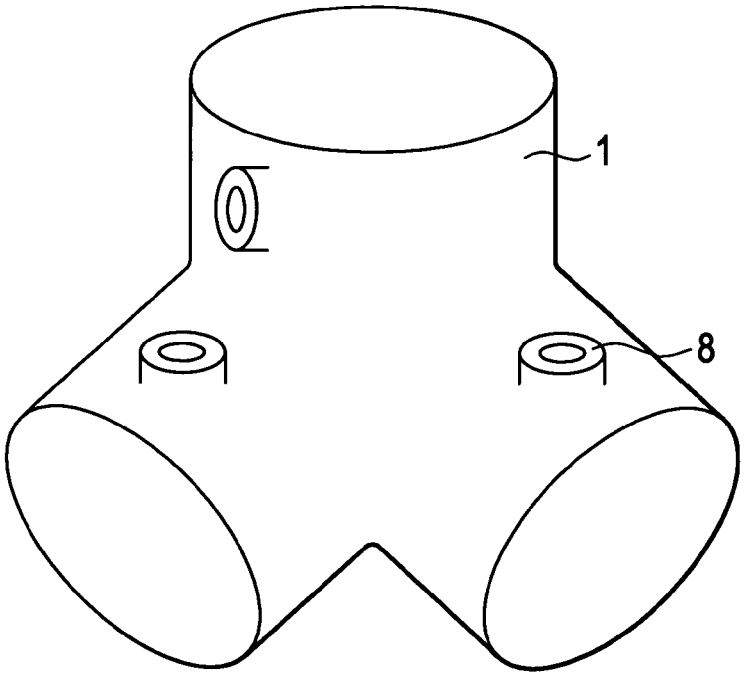

With reference to FIG. 3B, a three way connector 1 mates three members 3 of a frame at three or four positions on the top of the device forming a substantially square or rectangular shape. With reference to FIG. 3A a two way connector 2, or optionally a second three way connector 1, mates two members 3 of a frame at three or four positions on the bottom of the device forming a substantially square or rectangular shape.

Figure 4:
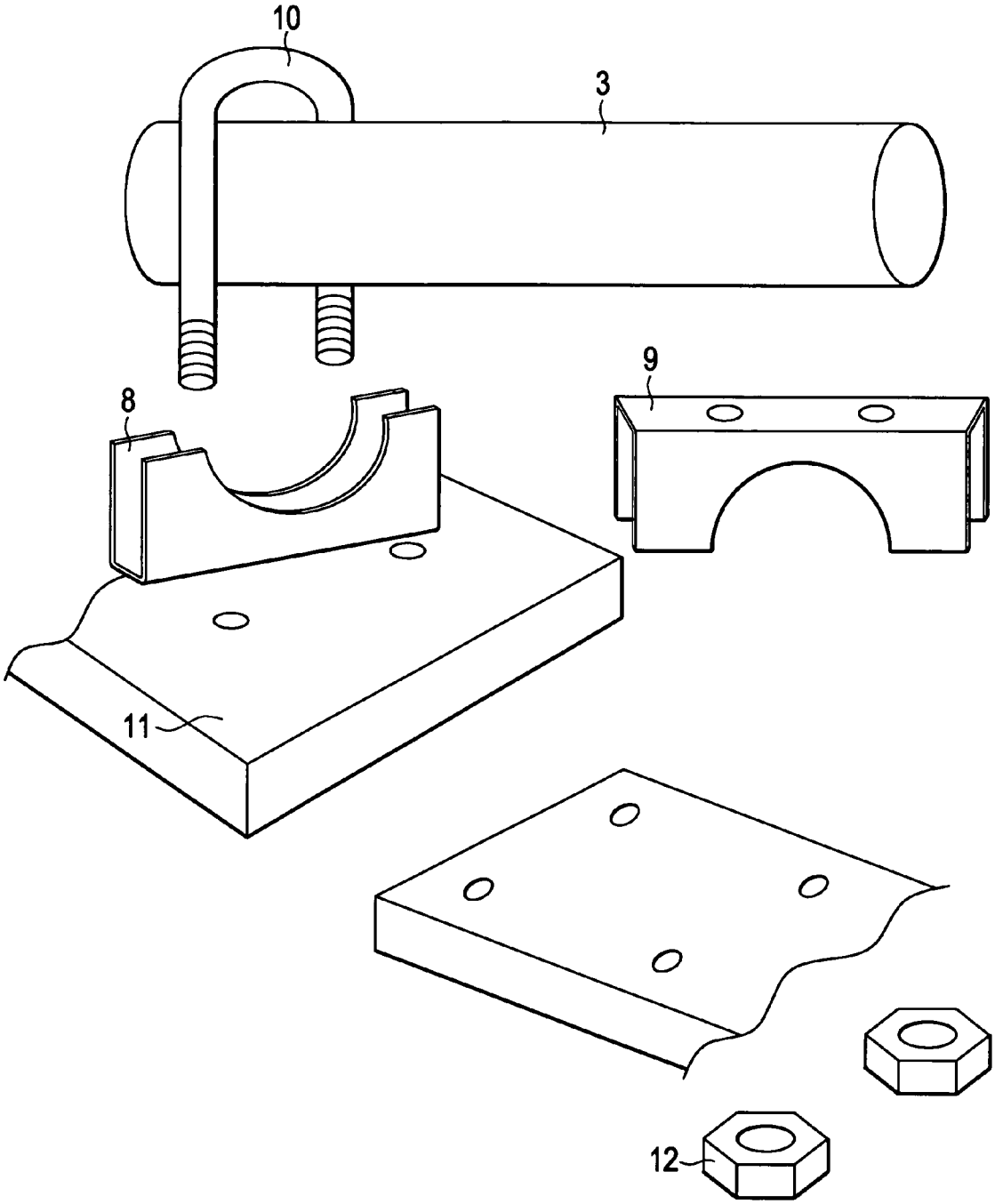
FIG. 4 represents a means for connecting a moving means to the scaffolding, frame or base.

With reference to FIG. 4, wheels 4 are mounted onto the scaffolding, frame or base to provide a means for easy movement. A wheel 4 may be attached to, connected to or affixed to members 3 of a frame at three or four positions on the bottom of the device. Optionally, the wheel 4 may be attached to, connected to or affixed to a member 3 of a frame at three or four positions on the bottom of the device. Optionally, the wheel 4 may be attached to, connected to or affixed to a three way connector 1 or a two way connector 2. The wheel 4 may engage the scaffolding, frame or base by a connecting means such as a U bolt 10 that may engage a base 11 via a connecting member 9. The assembly of the connecting means such as a U bolt 10 engaging a base 11 via a connecting member 9 may be secured by a securing means such as a bolt 12.

Figure 5A:
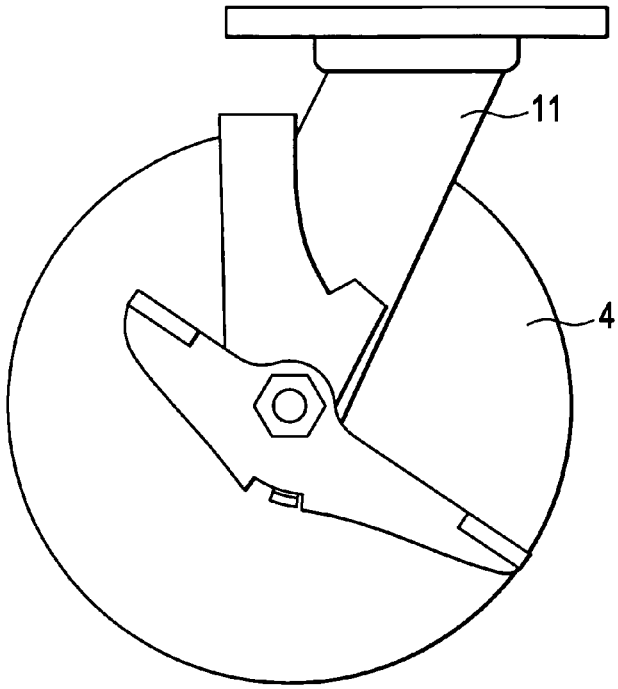
FIG. 5 A represents a side view and B a front or rear view of a moving means that may be connected to or mounted on the scaffolding, frame or base to enable easy movement.
Figure 5B:
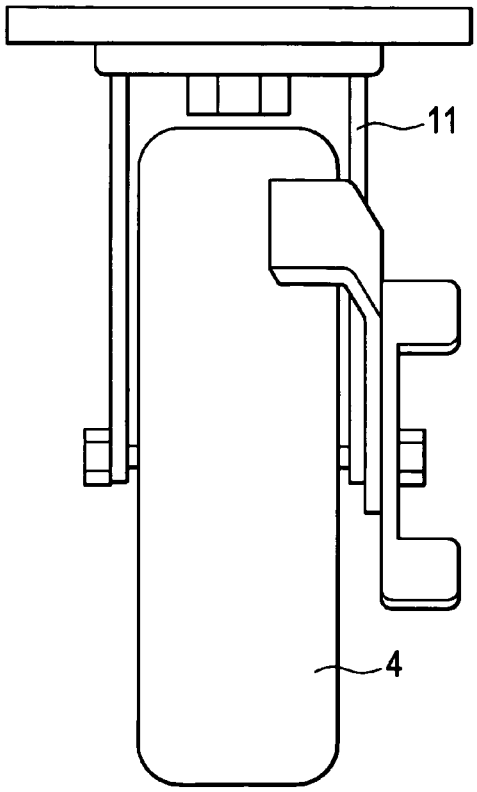

With reference to FIG. 5 A a side view and 5 B a front or rear view, the wheels 4 are engaged with or connected to a base 11, such as with the assembly depicted in FIG. 4.

Figure 6:
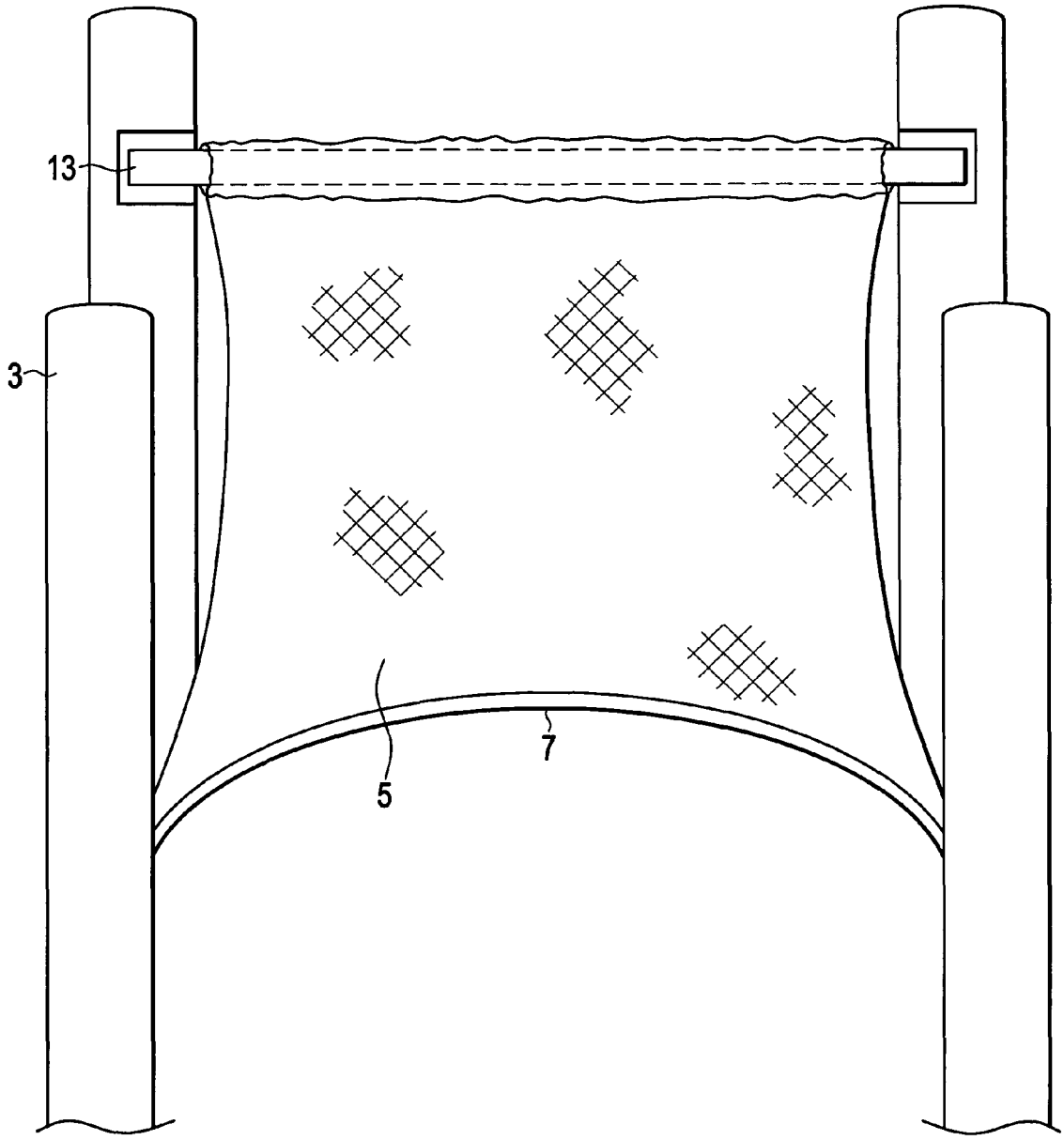
FIG. 6 represents a frontal view of a pouch illustrating a crescent shape of the back of the pouch thereby allowing a ball to pass from one pouch to the next and on to the bottom of the device to permit easy removal.

With reference to FIG. 6, a pouch 13 is formed. The rear extent or surface 7 of the pouch may define a substantially arc shaped aperture to allow passage of a ball from one pouch to another or to a bottom surface for easy collection. The pouch 5 may be supported by a cross bar 13 made of aluminum, plastic or any suitable material for the scaffold, frame or base. The cross bar 13 may engage, be connected to or continuous with the members 3 of the scaffold, frame or base. The pouch 5 may be adapted so as to extend around, encase or rely upon the crossbar 13 for support.

As best seen in reference to FIGS. 1 and 2, a free-standing scaffolding, frame or base forming a goal is illustrated. The scaffolding, frame or base may be constructed of a plurality of frame members in the form of pipes or tubing. The frame members can be provided from a variety of materials and may include materials such as aluminum, plastic, plastic metal, wood, fiberglass, or composite materials. Such materials may be provided in a variety of shapes. For instance, the frame elements may be selected from the above materials and have a structural shape of a rectangular, triangular, square, round, or other design or combinations of structural designs and which offer sufficient strength, durability, resilience, and desired weight.

The horizontal scaffolding, frame or base members 3 are combined to form a substantially square or rectangular top which is positioned parallel to and above a substantially square or rectangular bottom. Two, three or four horizontal scaffolding, frame or base members 3 may define the bottom of the scaffolding, frame or base. The top and bottom are connected by at least three, preferably four and in some embodiments more than four vertical scaffolding, frame or base members 3. As seen in reference to FIGS. 1 and 2, the horizontal scaffolding, frame or base members 3 are joined at substantially right angles to corresponding vertical scaffolding, frame or base members 3.

As seen in reference to FIGS. 1 2, and 6, a mesh or fabric covering 6, preferably in the form of a conventional net material such as a nylon or synthetic netting commonly employed in a conventional soccer goals or driving ranges is attached to or suspended over or substantially encases the scaffolding, frame or base. The mesh or fabric covering 6 may be permanently or temporarily attached to or affixed to the scaffolding, frame or base, such as with a fastening means or with stitches or it may be sewn in such a shape as to be readily draped over the scaffolding, frame or base. In some embodiments, the mesh or fabric 6 may be attached by hook- and loop-type fabric strips, snaps, or tied with string or tie-wraps or the like. In preferred embodiments, it is sewn in such a fashion that allows removing the top scaffolding, frame or base members 3 so that the mesh or fabric may then be secured around the vertical scaffolding, frame or base members 3. The top scaffolding, frame or base members 3 may then be placed through a corresponding pocket of the mesh or fabric on the top of the device and secured into the appropriate two way connectors 2 or three way connectors 1. In such embodiments, In preferred embodiments one or more cross bars 13 may be secured by attachment to one or more vertical scaffolding, frame or base members 3 to support one or more pouches 5. The cross bars 13 are preferably placed on a front surface of the scaffolding, frame or base.

The mesh or fabric covering 6 is preferably presewn as one piece designed to affix to or drape over the scaffolding, frame or base. The pouches 5 are preferably sewn, glued or affixed such as, for example, by a snap or fastener, to the mesh or fabric covering and form a part thereof. The mesh or fabric covering 6 may be formed of any suitable commercially available mesh material, such as, for instance, those appropriate for soccer goals or driving ranges. In some embodiments, the open spaces of the mesh are about ¼", ½", ¾", ⅞", 1", 1¼", 1½", 1¾", 2" or 2½" in size. Especially preferred is about ⅞" to about 1¾" in size. The mesh or fabric may be made of any suitable material such as, for instance, nylon, rayon, cotton, fiber, hemp, polypropylene or wool. The resulting elastic properties of the mesh or fabric 6 provide for a resiliency to the pouches 5 which facilitates the retention of balls within the pouches 5.

In some embodiments, fasteners such as in the form of a stake or in the form of a suction cup may be used to secure the scaffolding, frame or base to the ground or a floor. Alternatively, the scaffolding, frame or base may be supported by wheels 4 which may in some embodiments be retractable or lockable suitable for facilitating movement of the scaffolding, frame or base. Additionally, it is envisioned that in some embodiments, the scaffolding, frame or base may be readily disassembled into smaller component parts or constructed in a manner which folds into a more compact shape for storage or transportation.

The number of pouches 5 may be provided as is deemed appropriate to the primary goal of using the device. A plurality of pouches 5 may be equally spaced and formed on the mesh or fabric 6. Each pouch 5 may be designed so as to affix to a cross bar 13 on a back surface of the device. The number of pouches may vary according to the preferred size of the aperture allowing passage of the ball into the pouch 5 or according to the intended use of the device. For instance, there may be only 1, 2, 3, 4, 5, 6, 7, 8, 9, or 10 or more pouches 5. A substantially arc surface of the back surface of the pouches 7 may be present on the pouch 5 so as to connect to or affix to a back surface of the device. The substantially arc surface 7 is of an appropriate size so as to define an aperture in the pouch so that a ball of the desired size, such as, for instance, 1", 2", 3", 4", 5", 6", or even 12" or 18" or 24" in diameter may pass through thereby allowing a ball to descend from one pouch 5 to another pouch 5 until it reaches the bottom of the mesh or fabric 6. The bottom of the mesh or fabric 6 in turn defines a substantially solid piece without a substantially arc surface 7 thereby preventing further movement of a ball to the floor or ground. As a result, a ball may be easily retrieved from the device. The mesh or fabric 6 can optionally have a strike zone or target woven into the mesh or fabric 6 within a pouch 5. Bright or colored materials that contrast with the mesh or fabric 6 and background can be used.

The present invention provides a device having several unique uses. The device may be used by an individual or a team. The device provides a useful training tool where a soccer player may practice precise placement of kicks within the various pouches 5 defined by the mesh or fabric 6 and the device. Likewise, the device provides a useful training tool where a baseball or softball player may practice throwing or batting a ball within the various pouches 5 defined by the mesh or fabric 6 and the device. Similarly, the device provides a useful training tool where a football player may practice throwing or kicking a ball within the various pouches 5 defined by the mesh or fabric 6 and the device. The device may be used by having players either kick, throw, bat, propel by stick or bounce a ball with the aim of trying to have the ball captured in one of the pouches 5.

The shape and dimensions of the device and mesh or fabric 6 may be varied depending upon the particular ball game it is designed for, the available playing space as well as variations in size to accommodate variations in the ages and skill levels of players. For instance, a smaller size which may include a fewer number of pouches 5 may be developed for use in a garage or small gymnasium. Larger sizes may be used with more spacious indoor arrangements or use in a larger playing field or stadium. Accordingly, the present invention envisions that differences in relative sizes, number of pouches 5, and dimensions may be used in keeping with the present invention. Additionally, the device may be constructed to allow for disassembly or folding to assist in transportation and storage. In some embodiments, the device is at least about 4' tall, 5' tall, 6' tall, 7' tall, 8' tall, 9' tall, 10' tall or even 15' or 20' tall if desired. Especially preferred are devices in the 7'-9' tall range. In some embodiments, the device is at least about 1' wide, 2' wide, 3' wide, 4' wide, 5' wide, 6' wide, 10' wide or even 15' or 20' wide if desired. Especially preferred are devices in the 2'-3' wide range.

One or more additional transverse supports may be provided for the horizontal or vertical scaffolding, frame or base members 3. The transverse support may be provided in back, on one or more sides, on the top or on the bottom of the device. The scaffolding, frame or base is preferably formed of relatively light-weight aluminum or plastic plumbing-type materials. The parts are preferably press fit together so that they form a stable rigid framework that can be removed for compact and easy shipment. Select fittings may be chemically welded to the linear supports.

The invention claimed is:

1. An athletic ball training device comprising a) a frame, scaffold or base defined by at least four vertical members, having a top, a bottom, and two sides, b) a mesh or fabric adapted to attach to or drape over said frame, scaffold or base, c) a means of rolling connected to the bottom thereof and d) at least 3 pouches attached to or formed by said mesh or fabric, wherein said at least 3 pouches slope backwards from a front of said athletic ball training device, wherein said at least 3 pouches are adapted to receive a sports ball therein and wherein said at least 3 pouches are defined by a substantially arc shaped horizontal border on at least one side and wherein said substantially arc shaped horizontal border defines an aperture of sufficient size to allow passage of an athletic ball, wherein the athletic ball training device is substantially square or rectangular in shape on each side.

2. The device of claim 1 wherein the means of rolling comprises three or more wheels.

3. The device of claim 2 wherein said three or more wheels are lockable.

4. The device according to claim 1 being about 7 feet to about 9 feet tall.

5. The device according to claim 1 being about 2 feet to about 3 feet wide.

6. The device according to claim 1 wherein said mesh or fabric is adapted to substantially encase at least three vertical members of the scaffolding, frame or base and wherein said mesh or fabric is adapted to substantially encase at least three horizontal members of the scaffolding, frame or base at a top of the device and wherein said mesh or fabric is adapted to substantially encase at least three horizontal members of the scaffolding, frame or base at a bottom of the device.

7. The device according to claim 1 wherein said scaffolding, frame or base is formed of an aluminum.

8. The device according to claim 1 wherein said scaffolding, frame or base is formed of a plastic.

9. The device according to claim 1 wherein said sports ball is a baseball.

10. The device according to claim 1 wherein said sports ball is a soccer ball.

11. The device according to claim 1 wherein said sports ball is a football.

12. An athletic ball training device comprising a) a frame, scaffold or base defined by at least four vertical members, having a top, a bottom, and two sides, b) a mesh or fabric adapted to attach to or drape over said frame, scaffold or base, c) at least 3 pouches attached to or formed by said mesh or fabric, wherein said at least 3 pouches slope backwards from a front of said athletic ball training device, wherein said at least 3 pouches are adapted to receive a sports ball therein and wherein said at least 3 pouches are defined by a substantially arc shaped horizontal border on at least one side and wherein said substantially arc shaped horizontal border defines an aperture of sufficient size to allow passage of an athletic ball, and d) three or more wheels, wherein the athletic ball training device is substantially square or rectangular in shape on each side.

13. The device of claim 12, wherein said mesh or fabric is selected from the group consisting of knitted nylon, cotton, hemp, polypropylene, and rayon.

14. The device of claim 1 or 12 wherein the pouches are further adapted to allow for a ball to drop to the bottom of the device for easy access and removal.

* * * * *